United States Patent [19]

Jones et al.

[11] 4,007,871

[45] Feb. 15, 1977

[54] CENTRIFUGE FLUID CONTAINER

[75] Inventors: Alan Lytton Jones; Robert Melroy Kellogg, both of Endwell, N.Y.

[73] Assignee: International Business Machines Corporation, Armonk, N.Y.

[22] Filed: Nov. 13, 1975

[21] Appl. No.: 631,546

[52] U.S. Cl. ..... 233/27; 210/DIG. 23

[51] Int. Cl.[2] ..... B04B 15/06

[58] Field of Search ..... 233/26, 27, 1 R, 1 A, 233/1 E, 1 D, 31; 128/2 F; 210/DIG. 23; 23/259

[56] References Cited

UNITED STATES PATENTS

| | | | |
|---|---|---|---|
| 3,244,363 | 4/1966 | Hein | 233/26 X |
| 3,326,458 | 6/1967 | Meryman et al. | 233/27 |
| 3,679,128 | 7/1972 | Unger et al. | 233/27 |
| 3,708,110 | 1/1973 | Unger et al. | 233/26 |
| 3,724,747 | 4/1973 | Unger et al. | 233/26 X |
| 3,748,101 | 7/1973 | Jones et al. | 233/26 X |

*Primary Examiner*—George H. Krizmanich
*Attorney, Agent, or Firm*—Paul M. Brannen

[57] ABSTRACT

A fluid container particularly useful in a centrifuge system for separating the various fractions in blood. The container comprises two circular sheets of flexible material, having central openings therein. The outer peripheral edges are sealed together, as well as an annular portion extending outwardly from the central opening. A radial arcuate portion is sealed off, thereby providing an interrupted or discontinuous annular chamber. At one end of the interrupted annular chamber, an inlet tube is provided, extending outwardly from the central opening and communicating with one end of the interrupted annular chamber. At the other end of the interrupted annular chamber, there is provided a radially enlarged portion, which acts as a collection chamber for the various portions of the fluid separated by centrifugal force. The various portions, or fractions, will exist at different radial distances from the center of the bag. A plurality of outlet tubes extend radially outward from the center of the bag to open within the collection chamber at different radial distances. Through these outlet tubes, selected separated portions of the fluid are withdrawn from the bag.

4 Claims, 6 Drawing Figures

CENTRIFUGE FLUID CONTAINER

CROSS REFERENCE TO RELATED APPLICATION

This application is related to a copending application Ser. No. 634,209, filed on Nov. 21, 1975, and assigned to the same assignee as this application.

FIELD OF THE INVENTION

This invention relates to fluid centrifuges, and particularly to an improved disposable centrifuge bag or container.

BACKGROUND OF THE INVENTION

Previous centrifuges for separating the components of blood are known in which the centrifuge bank or chamber is reusable. These devices must be thoroughly cleaned and sterilized after each use, a costly and time-consuming procedure.

DESCRIPTION OF PRIOR ART

Bag-like containers for holding blood or other fluids for processing are known in the art as shown, for example, in U.S. Pat. Nos. 3,064,647 — R. P. Earl; 3,096,283 — G. N. Hein; 3,145,713 — A. Latham, Jr.; 3,239,136 — G. N. Hein; 3,244,362 — G. N. Hein; 3,244,363 — G. N. Hein; 3,297,243 — G. N. Hein; 3,297,244 — G. N. Hein; 3,326,458 — H. T. Meryman et al; 3,456,875 — G. N. Hein; 3,545,671 — E. D. Ross; 3,679,128 — H. P. O. Unger et al; 3,708,110 — H. P. O. Unger et al; 3,724,747 — H. P. O. Unger et al; 3,748,101 — A. L. Jones et al; and 3,858,796 — H. P. O. Unger et al. Also, IBM Technical Disclosure Bulletin, Volume 17, No. 2, July 1974, pages 404 and 405. However, none of this prior art discloses a bag configuration as herein disclosed and claimed, including an interrupted or discontinuous annulus as a centrifuging channel.

In citing the above prior art, no representation is made nor intended that a search has been made, that better art than that listed is not available, or that other art is not applicable.

SUMMARY OF THE INVENTION

It is a general object of this invention to provide an improved fluid container.

A particular object of the invention is to provide an improved fluid container for centrifuging blood to obtain different fractions thereof.

Another object of the invention is to provide an improved fluid container for centrifuging blood, which is simple and economical in construction, disposable after a single use.

The foregoing and other objects, features and advantages of the invention will be apparent from the following more particular discription of a preferred embodiment of the invention, as illustrated in the accompanying drawings, and described in connection therewith in the annexed specification.

Briefly described, the improved fluid container provided by this invention is an interrupted or discontinuous toroidal or annular shaped container when filled with fluid. It is preferably formed by sealing two identical circular pieces of suitable flexible elastic material, such as medical-grade polyvinylchloride, at the periphery thereof and at selected interior portions, to thereby provide an interrupted or discontinuous annular chamber. The parts are proportioned and arranged so that at one end of the annular portion, an enlarged chamber or volume is provided from which selected blood fractions can be withdrawn.

An inlet tube is molded into or sealed into the bag, having its interior end opening into the small end of the discontinuous annular chamber. A plurality of outlet tubes are provided, opening into the enlarged end of the chamber, each tube extending radially outwardly to a different distance, so that the various blood fractions which exist at different radial locations as a result of the centrifuging, can be selectively drawn off.

BRIEF DESCRIPTION OF DRAWINGS

In the drawings.

Similar reference characters refer to similar parts in each of the several views.

DETAILED DESCRIPTION OF A PREFERRED EMBODIMENT

Figure 1:
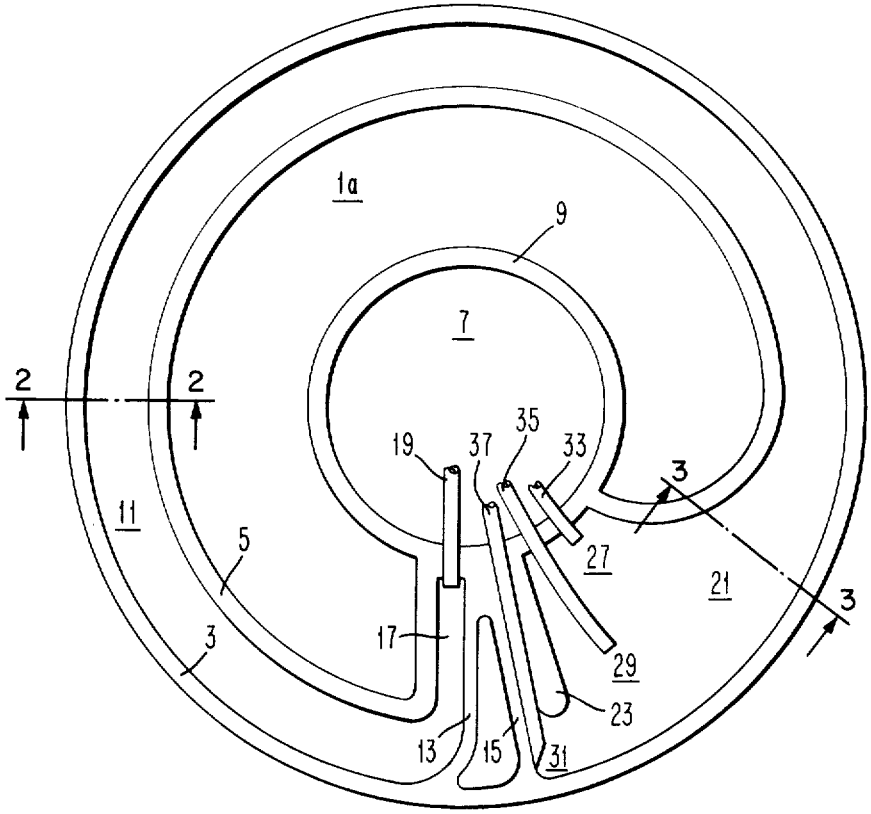
FIG. 1 is a diagrammatic plan view of a fluid container comprising a preferred form of the invention.

Referring to the drawings, the fluid container is circular in shape as can be seen in FIG. 1. Two circular pieces of suitable plastic material 1*a* and 1*b*, forming the top and bottom of bag, are sealed together at their periphery, as by suitable heat and pressure, forming a fluid-tight weld 3 at the outer edge of the bag. At a first predetermined distance radially inward from the periphery, a second sealed portion 5 is provided, comprising a thin weld extending almost around the circumference of the bag as shown.

A central opening 7 is provided in the circular pieces, and the juxtaposed edges are welded to form the interior boundary seam 9 as shown.

The discontinuous or interrupted annular chamber 11 formed principally by the welds 3 and 5 is not continuous around the periphery of the bag, and is interrupted by intervening welds 13 and 15. The continuation of weld 5 and the weld 13 provide a radially disposed inlet portion 17, and an inlet tube 19 is welded or sealed into this chamber at the central opening 7 as shown.

The discontinuous or interrupted annular chamber is enlarged at the other end from the inlet chamber, into a collection and outlet chamber 21. A plurality of outlet subregions are formed by radially extending weld 23, and the separating weld 15.

Into each of the collecting subregions thus formed, namely 27, 29 and 31, there extends an associated outlet tube 33, 35 and 37, extending from the central opening 7 radially outward to the associated chamber. The tubes are sealed or welded in place between the pieces 1*a* and 1*b*. The outlet tubes vary in length, and open at increasing radial distances from the central opening. The various fractions of the centrifuged blood collect in chamber 21, separated by density into layers, the outermost of which are the red blood cells, having the greatest density, followed by the white blood cells and the plasma, in that order, progressing inwardly.

Figure 2:
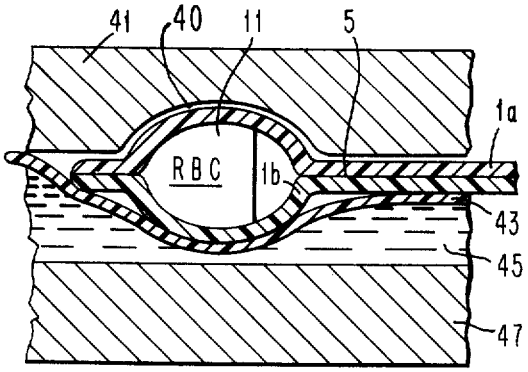
FIG. 2 is a diagrammatic sectional elevation view of the container of FIG. 1, taken at the section 2—2.
Figure 3:
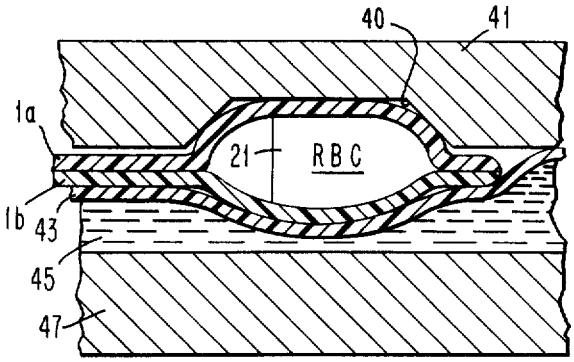
FIG. 3 is a diagrammatic sectional elevation view of the container of FIG. 1 taken at the section 3—3.
Figure 4:
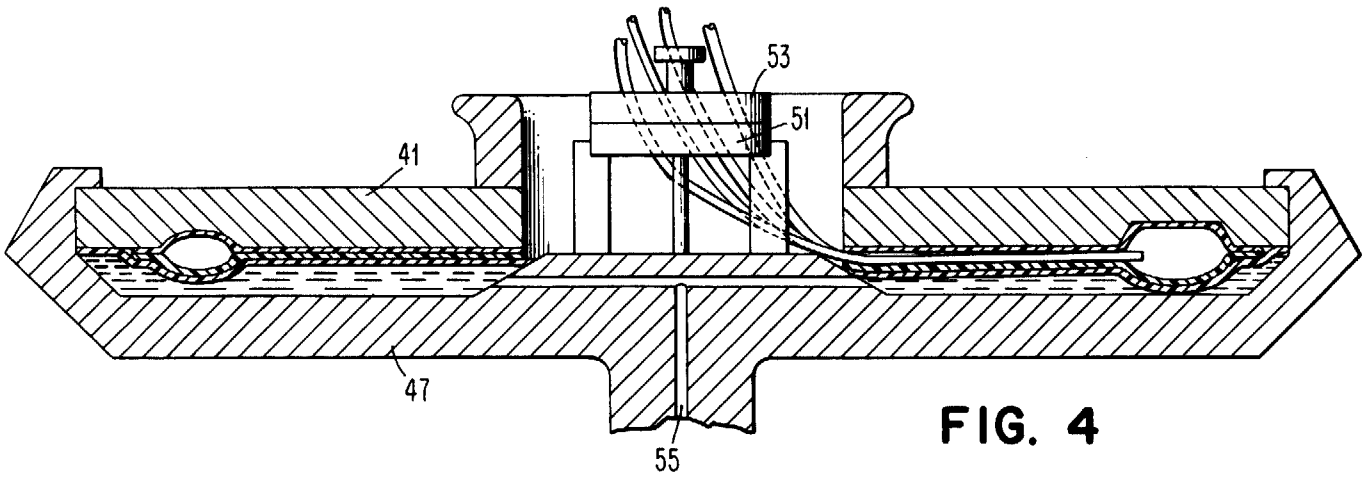
FIG. 4 is a schematic cross-section elevation view of a centrifuge assembly using a container according to the present invention.

FIGS. 2 and 3 show the cross-section views of the collection channel 11, at the points indicated by 2—2 and 3—3 in FIG. 1 respectively, and with the bag in place in the centrifuge structure, more of which will be said in connection with the description of FIG. 4.

FIG. 2 shows how the channel, when filled, has the upper portion of its cross section received in a groove or recess 40 in the centrifuge cover 41. The bag is supported from beneath by a flexible membrane 43, and underlying hydraulic fluid 45, which occupies the space between the flexible membrane 43 and the bottom 47 of the centrifuge bowl.

FIG. 3 is a cross-section view at line 3—3 of FIG. 1, and shows a portion of the enlarged collection chamber 21. It will be seen that the red blood cells, RBC, occupy the greater portion of the chamber in the outermost portions of the chamber.

The hydraulic fluid 45 equalizes the pressure to keep the bag from breaking and also keeps the centrifuge bowl in balance, since the dispersion of the fluid in the bag is not symmetric.

FIG. 4 illustrates the manner in which the bag is mounted in the centrifuge mechanism. The centrifuge top 41 is arranged to be engaged by the bottom portion 47 of the centrifuge bowl by means such as an interrupted screw type of mounting, not shown, by which the bag can be placed in the position, as shown, the top lowered on top of it and then by partial rotation of the top with respect to the bottom, the top is locked in place. The tubing connections to the bag terminate in rotating portion 51 of a rotating seal, the stationary portion 53 being mounted on top of the rotating portion, as shown, with output and inlet connections therefrom, as can be seen in the drawing. The hydraulic fluid beneath the flexible diaphragm is supplied via a channel 55 from a fluid source, not shown, which adequately supplies the hydraulic fluid in the space beneath the flexible bag, as previously pointed out.

The blood to be processed enters the bag through the rotating seal and the inlet tube. The blood then flows around the periphery of the bag in the channel 11, while being subject to a radial acceleration force caused by the rotation of the bowl. It eventually reaches the collection chamber 21, where the red cells and plasma are drawn off through the appropriate output tubes and through the rotating seal to the stationary outlet plumbing. The white cells collect at the interface between the red cells and plasma and the position of this interface can be controlled by relative speed of the pumps associated with equipment of this type.

Figure 5B:
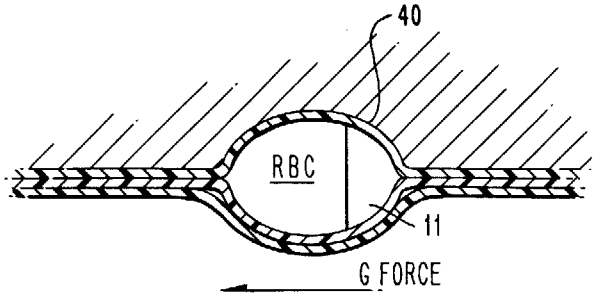
FIGS. 5A and 5B are schematic cross-sectional elevation views of configurations without and with relief grooves in the centrifuge lid.
Figure 5A:
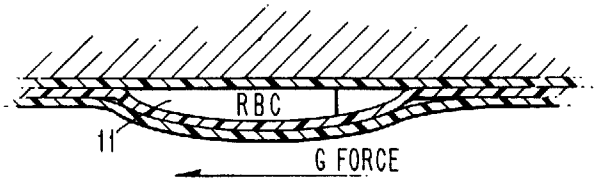

FIG. 5A shows how, in the absence of groove or recess 40 due to the large centrifugally induced hydrostatic pressure, the bag will be tightly pressed against the underside of the centrifuge cover. This inhibits the deformation of the lower layer of the bag. Accordingly, the separation channel 11 in this instance is very flat and the blood will pass very quickly through such an arrangement since the cross-sectional area is very small. On the other hand, when the centrifuge cover is grooved as shown in FIG. 5B, the channel 11 will be much wider with resultant better separation due to the longer time that the blood is within the channel, since its flow velocity is thereby decreased.

From the foregoing, it will be apparent that the present invention provides a novel centrifuge container which is advantageous from the standpoint of being economical to fabricate and because it is adapted to single use, wherein the bag with its associated tubing, etc., is used one time and then discarded, thereby relieving the duties of cleaning and sterilization required with reusable centrifuge containers.

While the invention has been particularly shown and described with reference to a preferred embodiment thereof, it will be understood by those skilled in the art that various changes in form and details may be made therein without departing from the spirit and scope of the invention.

We claim:

1. A flexible collapsible blood processing container for centrifuging whole blood to separate it into fractions according to density, comprising, an outer fluid channel having opposite ends and comprising an interrupted annulus having an elliptical cross section when filled, a central opening in said container, and a plurality of tubing connections extending radially outward from said central opening to opposite ends of said fluid channel, the openings of said tubing connections in said channel having different radial distances from said central opening.

2. A container as claimed in claim 1, in which at least one of said tubing connections is used as an outlet, and in which the portion of said fluid channel in which the tubing connection used as an outlet is located, is enlarged radially inward to form a collection chamber.

3. A container as claimed in claim 1, in which the container is formed of two circular pieces of material sealed together at the outer periphery at the edges of the central opening, and at selected areas to form said channel.

4. A container as claimed in claim 1, in which said interrupted annulus has a first and a second end, and in which one of said tubing connections opens into said first end of said annulus to operate as an input fluid connection, and the remaining ones of said connections open into the second end of said annulus to function as output fluid connections.

* * * * *